US008540544B1

(12) United States Patent
Logue

(10) Patent No.: US 8,540,544 B1
(45) Date of Patent: Sep. 24, 2013

(54) NOVELTY BAND FOR STORING AND DISPLAYING TOY FIGURES

(76) Inventor: Dax Logue, Scottsdale, AZ (US)

( * ) Notice: Subject to any disclaimer, the term of this patent is extended or adjusted under 35 U.S.C. 154(b) by 234 days.

(21) Appl. No.: 13/081,041

(22) Filed: Apr. 6, 2011

(51) Int. Cl.
*A63H 33/00* (2006.01)

(52) U.S. Cl.
USPC ..... 446/26; 446/101; 63/29.1; 63/40; D11/3; D11/79

(58) Field of Classification Search
USPC ..... 63/21, 23, 29.1, 40; 446/26, 27, 446/101; D11/3, 79
See application file for complete search history.

(56) References Cited

U.S. PATENT DOCUMENTS

| | | | | |
|---|---|---|---|---|
| 2,959,888 | A * | 11/1960 | Noble | 446/101 |
| 3,392,480 | A * | 7/1968 | Stubbmann | 446/101 |
| 4,789,369 | A * | 12/1988 | Lyman | 446/101 |
| 4,827,575 | A * | 5/1989 | Delaney | 63/29.1 |
| 4,936,699 | A * | 6/1990 | Yoshida | 446/26 |
| 5,893,377 | A * | 4/1999 | Chen | 132/275 |
| 5,901,381 | A * | 5/1999 | Nelson | 2/209.13 |
| 6,047,709 | A * | 4/2000 | Tu | 446/27 |
| 6,213,839 | B1 * | 4/2001 | Pedersen | 446/101 |
| 6,289,903 | B1 * | 9/2001 | Haufler | 63/40 |
| 6,626,184 | B1 * | 9/2003 | Cheng | 132/275 |
| 6,776,682 | B2 * | 8/2004 | Engel et al. | 446/101 |
| D543,127 | S | 5/2007 | Daas | |
| D559,473 | S | 1/2008 | Nguyen | |
| 7,316,130 | B2 * | 1/2008 | Morkenborg | 63/29.1 |
| 8,007,338 | B2 * | 8/2011 | Stevkovski | 446/101 |
| 2007/0167106 | A1 * | 7/2007 | Hoover | 446/26 |

* cited by examiner

*Primary Examiner* — Gene Kim
*Assistant Examiner* — Urszula M Cegielnik
(74) *Attorney, Agent, or Firm* — LaMorte & Associates P.C.

(57) ABSTRACT

A novelty assembly that is used to retain and display toy figures. The assembly utilizes a band having a first surface and a second surface. The band can be formed as a bracelet, necklace, headband, belt, shoe strap, handle strap, or the like. A plurality of nub projections extend from the first surface of the band. A plurality of toy figures are provided. Each of the toy figures has a bottom opening. The bottom opening of each toy figure is pressed onto one of the nub projections that extend from the band. The bottom opening of the toy figures receive and engage the nub projection with a friction fit. This interconnects the toy figures with the band. The result is a novelty band or strap where the toy figures appear to be the ornamentation of the novelty.

12 Claims, 4 Drawing Sheets

NOVELTY BAND FOR STORING AND DISPLAYING TOY FIGURES

BACKGROUND OF THE INVENTION

1. Field of the Invention

In general, the present invention relates to ornamental attachments for bands, such as bracelets, necklaces, shoe straps, backpack straps, and belts that are worn by a person. More particularly, the present invention relates to such bands that have protrusions designed to engage and retain secondary objects.

2. Prior Art Description

The prior art is replete with band designs, such as bracelets, necklaces, collars, shoe straps and belts that are worn on the body. Such bands are often adorned with protruding objects, such as spikes, studs, and other such objects. However, such adornments are present on the bands merely for aesthetics and/or fashion. Such adornments usually serve no significant functional purpose. This prior art is exemplified by U.S. Pat. No. D559,473 to Nguyen, entitled Pet Leg Bracelet and U.S. Pat. No. D543,127 to Daas, entitled Bracelet.

In the toy industry, small toy figures made from elastomeric material have become popular. Such toy figures are typically under an inch tall and weigh under ten grams. Such toy figures are produced by a variety of manufacturers and are sold under popular trade names such as Sqwishland®, Jungle Mania® and Sea Mania®. Such miniature toy characters are typically manufactured to have hollow interiors. By making the toy figures hollow, less raw material is needed and the toy figures are therefore cheaper to manufacture.

In order to manufacture such small toy figures with hollow interiors, a hole is typically formed in the base of the toy figure. Although this hole is a result of making the toy figure hollow, the hole does have other useful functions. The presence of the hole enables the toy figure to engage the eraser end of a pencil or the backend of a pen. In this manner, the toy figure can be used to decorate a pencil or pen. It is for this reason that such small toy figures are often referred to as "toppers" in the marketplace, being that the toy figures can "top" a pen or a pencil.

Since small toy figures are becoming increasingly popular, many children have begun to collect them. However, the toy figures themselves are small and are easily lost. Accordingly, collections of such toy figures should not be just thrown into a book bag or stuffed into a pocket. Rather, the small toy characters should be retained. It is for this reason that manufacturers are now producing play sets, bags and/or other items specifically designed to hold the small toy characters they make. The problem with such prior art storage devices is that the toy characters cannot be seen unless the storage device is open. It is therefore difficult to display a collection without removing the toy characters from their storage device.

The present invention is a device and method for both storing and displaying a collection of small toy figures. The present invention device and method provides a band with protrusions that engage and hold hollow interior of the toy figure. In this manner, the toy figure can be retained while simultaneously being displayed. The details of the present invention are described and claimed below.

SUMMARY OF THE INVENTION

The present invention is a novelty assembly that is used to retain and display toy figures. The assembly utilizes a band having a first surface and a second surface. The band can be formed as a bracelet, necklace, headband, shoe strap, belt, or any other strap item that is worn or carried by a person. A plurality of nub projections extend from the first surface of the band.

A plurality of toy figures are provided. Each of the toy figures has a bottom opening. The bottom opening of each toy figure is pressed onto one of the nub projections that extends from the band. The bottom opening of the toy figures receive and engage the nub projection with a friction fit. This interconnects the toy figures with the band. The result is a novelty bracelet, necklace, headband, strap, or belt, where the toy figures appear to be the ornamentation of the novelty.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention assembly can be embodied in many ways, only three exemplary embodiments are provided as illustrations. These embodiments were selected in order to set forth two of the best modes contemplated for the invention. The illustrated embodiments, however, are merely exemplary and should not be considered a limitation when interpreting the scope of the appended claims.

Figure 1:
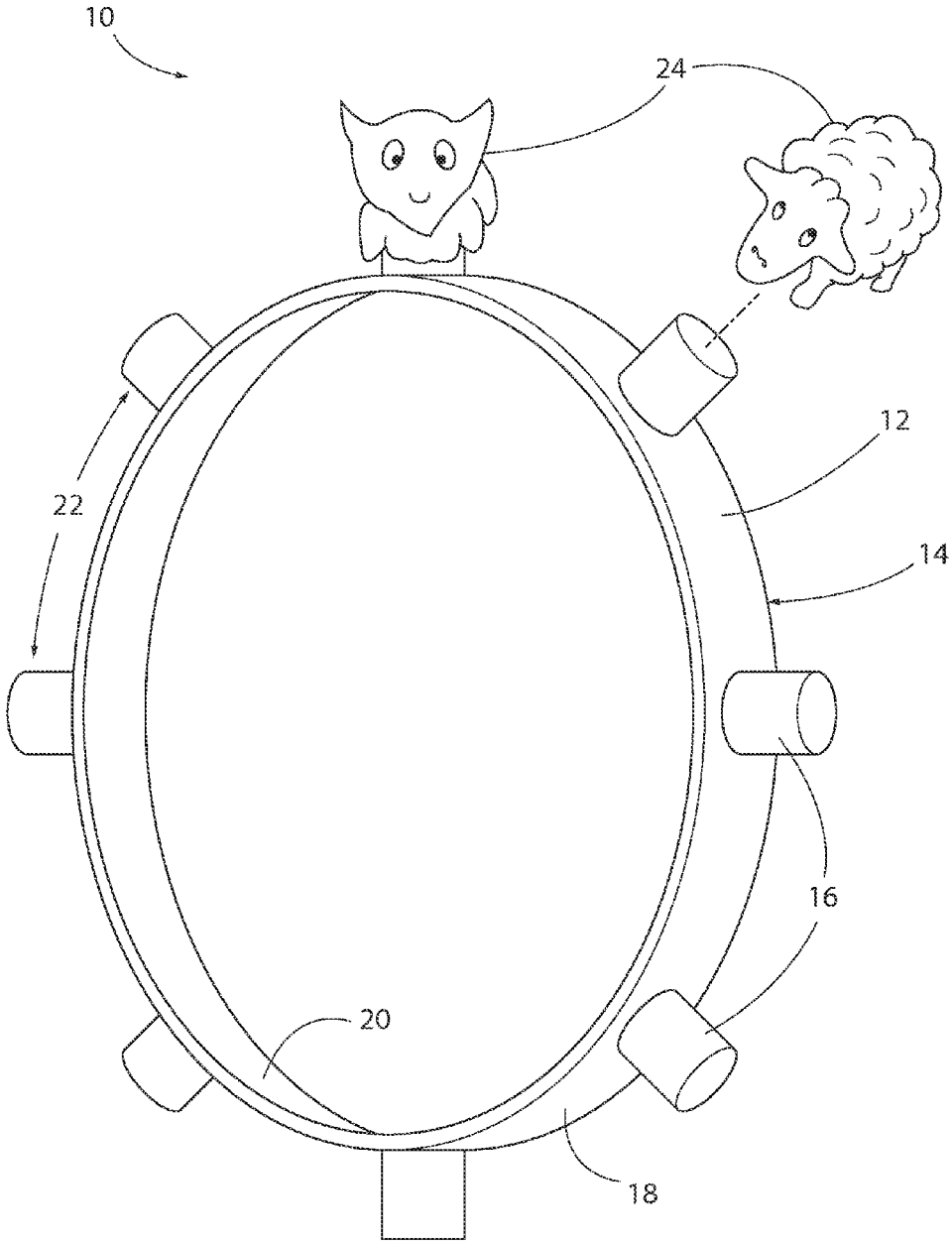
FIG. 1 is a perspective view of an exemplary embodiment of a novelty assembly configured as a bracelet.
Figure 2:
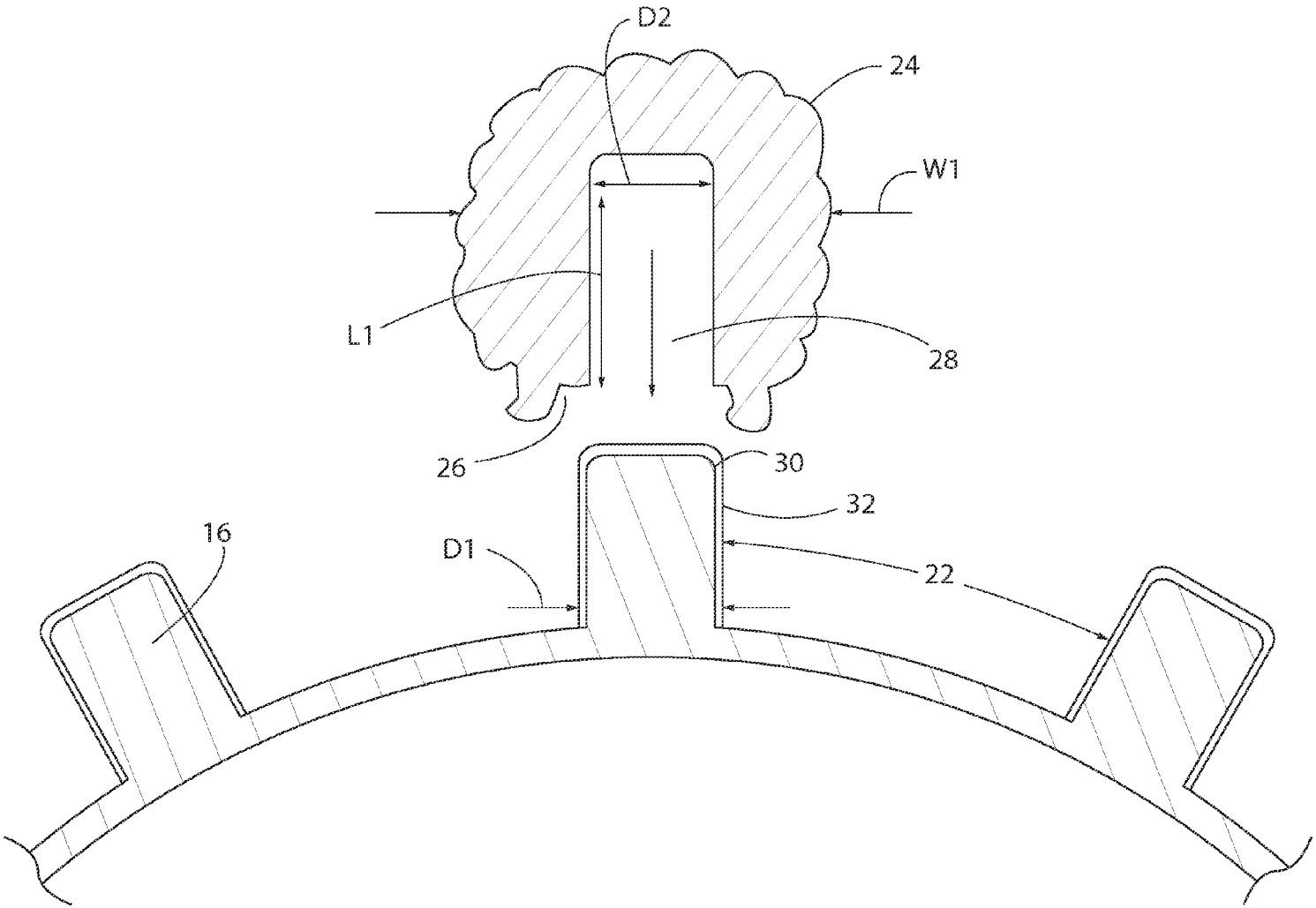
FIG. 2 is a cross-sectional view of the embodiment shown in FIG. 1.

Referring to FIG. 1 and FIG. 2, the present invention assembly 10 utilizes a band 12 that is formed in the general shape of a bracelet 14. The band 12 is continuous and conforms to an annular shape. The band 12 has a width of between 5 mm and 15 mm. The thickness of the band 12 is preferably between 1 mm and 4 mm. Lastly, the inside diameter of the annular shape formed by the band 12 is preferably between 6 cm and 10 cm. In this manner, the band 12 is sized to fit onto the wrist of most children and young adults.

The band 12 is molded from an elastomeric material, such as silicon rubber or a thermoplastic elastomer (TPE) material. In this manner, the band 12 is capable of elastically stretching. This helps the band 12 stretch over the hand and pass onto the wrist of a user.

The band 12 has a first outside surface 18 and a second inside surface 20. A plurality of nub protrusions 16 radially extend from the outside surface 18 of the band 12. Each of the nub protrusions 16 is preferably molded from the same elastomeric material as the band 12. It is preferred that the band 12 and the various nub protrusions 16 be molded together as one integral piece in an injection molding machine.

Each of the nub protrusions 16 is cylindrical in shape. Accordingly, each nub protrusion 16 has a length L1 and a diameter D1. The nub protrusions 16 are separated by a pitch spacing 22. The preferred pitch spacing 22 between adjacent nub protrusions 16 is preferably between 1 cm and 2 cm.

In the shown embodiment, the nub protrusions 16 are symmetrically spaced around the band 12. Although this equidistant pitch spacing is preferred for bracelets, such pitch spacing can be changed for other band types, such as necklaces and belts.

A plurality of toy figures 24 are provided. Each of the toy figures 24 has a bottom surface 26. Each of the toy figures 24 has a maximum width W1. It will be understood that the pitch spacing 22 between adjacent nub protrusions 16 is greater than the maximum width W1 of the toy figures 24. In this manner, two toy figures can be mounted to the bracelet 14 side-by-side without touching.

Each of the toy figures 24 has a central opening 28 that is accessible from the bottom surface 26 of the toy figure 24. The central opening 28 has a depth, which is at least as deep as the length L1 of the nub protrusions 16. Furthermore, the central opening 28 in each toy figure 24 has an inside diameter D2. The inside diameter D2 of the central opening 28 is smaller than the diameter D1 of the nub protrusions 16.

To connect a toy figure 24 to the band 12, the bottom surface 26 of that toy figure 24 is oriented toward the band 12. The central opening 28 of the toy figure 24 is then pressed over one of the nub protrusions 16 so that the nub protrusion 16 is forced into the central opening 28 with an interference fit. Each nub projection 16 has a rounded top edge 30 that helps to ease the interconnection. Once a nub protrusion 16 is inserted into a central opening 28, the nub protrusions 16 and the material of the toy figure 24 around the central opening 28 are locked together with a friction fit.

Elastomeric polymers have a very high coefficient of friction. Accordingly, when a toy figure 24 is engaged with a nub protrusion 16, the interconnection caused by the friction fit is significant. As a result, the toy figures 24 will not inadvertently disconnect from the bracelet 14 merely due to the forces of gravity or the forces of momentum as the bracelet 14 moves with the arm. Rather, the toy figure 24 will remain in place on the nub protrusion 16 of the band 12 until the toy figure 24 is physically grasped and pulled from the nub protrusion 16. The preferred interconnection created by the interference fit preferably requires a pull force of at least 0.20 kilograms to achieve separation. This force is at least 50 times greater than the actual weight of the toy character.

Since the interconnection created by the friction fit is so strong, it may be difficult for some children to properly set a toy figure 24 in place on a nub protrusion 16. To help reduce the difficulty of setting a toy figure 24 onto a nub protrusion 16, each nub protrusion 16 has a rounded top edge 30. This helps the nub protrusion 16 align with the central openings 28 in the toy figures 24. Furthermore, each of the nub protrusions 16 can be painted with a paint coating 32. The paint coating 32 on the nub protrusions 16 has a lower coefficient of friction than does the elastomeric material of the nub protrusion 16 itself. Consequently, the paint coating 32 acts as a lubricant and reduces the frictional forces between the nub protrusions 16 and the toy figure 24.

Figure 3:
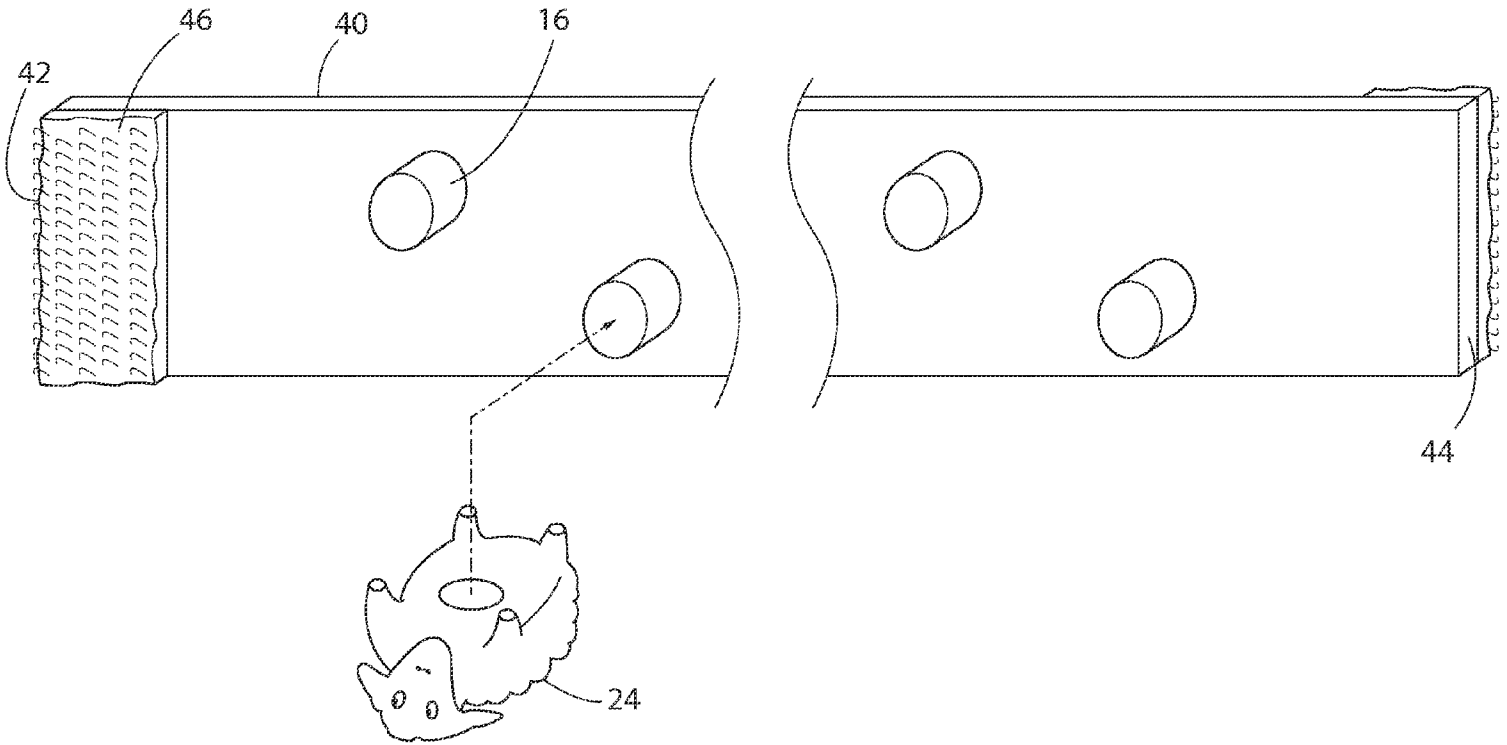
FIG. 3 is a perspective view of an alternate embodiment of the present invention assembly being configured with an open band.

Referring to FIG. 3, an alternate embodiment of the present invention is shown. In this embodiment, a band 40 is provided having a first end 42 and a second end 44. The two ends 42, 44 are provided with a connection mechanism 46, such as a buckle, clip connector, or Velcro® patches that enable the two ends 42, 44 to be interconnected to form a closed loop. The length of the band 40 can vary. Short bands can be used as bracelets. Long bands can be used as belts. Intermediate bands can be used as headbands and necklaces.

The illustrated embodiment of the band 40 has nub protrusions 16 only in one section of the band 40. The nub protrusions 16 have the structure previously described and engage toy figures 24 in the manner previously described. The embodiment of FIG. 3 shows that the nub protrusions 16 need not be evenly spaced or linearly aligned. Rather, what is of importance is that the spacing between adjacent nub protrusions 16 be sufficient enough to accommodate the toy figures 24.

Figure 4:
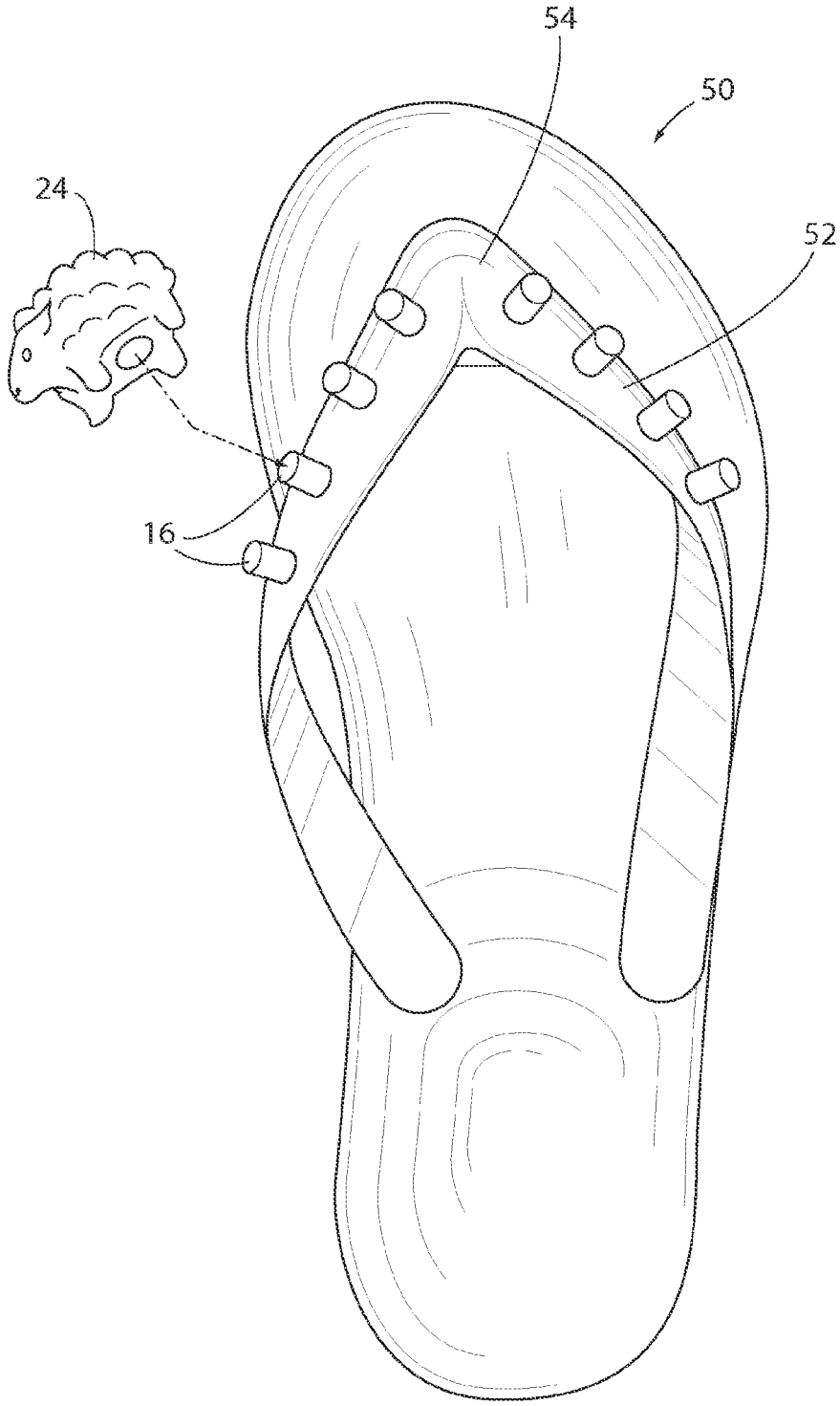
FIG. 4 is a perspective view of an alternate embodiment of the present invention being configured on the strap of a sandal.

Referring now to FIG. 4, a sandal 50 is shown having a foot strap 52. The foot strap 52 is primarily used to hold the sandal 50 on the foot. The foot strap 52 has a top surface 54. Nub protrusions 16 extend outwardly from the top surface 54 of the foot strap 52. The nub protrusions 16 have the structure previously described and engage toy figures 24 in the manner previously described.

The embodiment of FIG. 4 shows that the nub protrusions 16 need not be on novelty jewelry. Rather, the nub projections 16 can be on straps, such as shoe straps, backpack straps, bag straps and purse straps that are worn by a person or carried by a person.

It will be understood that the embodiments of the present invention that are illustrated and described are merely exemplary and that a person skilled in the art can make many variations to those embodiments. For instance, the number of nub projections, the spacing of the nub projections, and the appearance of the nub projections can all be altered. Likewise, the toy figures can be altered in size, number, and appearance. All such embodiments are intended to be included within the scope of the present invention as defined by the claims.

What is claimed is:

1. A novelty assembly comprising:

a band having a first surface and a second surface;

a plurality of nubs extending from said first surface of said band, each of said plurality of nubs being cylindrical in shape, having a first length and a first diameter that extends along said first length, wherein said plurality of nubs are separated by a pitch spacing along said band, and wherein each of said plurality of nubs is fabricated from an elastomeric material that has a high first coefficient friction;

a coating of paint covering each of said plurality of nubs, wherein said coating of paint has a second coefficient of friction that is lower than said first coefficient of friction;

a plurality of toy figures, each of said toy figures having a bottom opening of a second diameter, wherein said second diameter of each said bottom opening is smaller than said first diameter of each of said plurality of nubs, wherein said bottom opening of each of said toy figures receives and engages one of said plurality of nubs with a friction fit, therein interconnecting said plurality of toy figures with said band.

2. The assembly according to claim 1, wherein said band and said plurality of nubs are unistructurally molded as a single plastic form.

3. The assembly according to claim 1, wherein said band forms a continuous loop.

4. The assembly according to claim 1, wherein said plurality of nubs are equidistantly spaced along said band.

5. The assembly according to claim 1, wherein said band has a first end, an opposite second end and a connector for selectively interconnecting said first end to said second end.

6. The assembly according to claim 1, wherein said toy figures have a predetermined maximum width and said pitch spacing between said plurality of nubs are at least as wide as said predetermined maximum width.

7. A novelty assembly comprising:

a band having an outwardly facing surface and an inwardly facing surface;

a plurality of protrusions radially extending from said outwardly facing surface of said band, each of said plurality of protrusions being cylindrical in shape, having a first length and a first diameter that extends along said first length, and wherein each of said plurality of protrusions is fabricated from an elastomeric material that has a high first coefficient friction;

a plurality of toy figures molded from elastomeric material, wherein each of said toy figures has a bottom opening of a second diameter, wherein said second diameter of each said bottom opening is smaller than said first diameter of each of said plurality of protrusions, wherein each said bottom opening receives and engages one of said plurality of protrusions with an interference fit, therein joining said plurality of toy figures to said band.

8. The assembly according to claim 7, wherein said band and said plurality of protrusions are unistructurally molded as a single plastic form.

9. The assembly according to claim 7, further including a coating of paint covering each of said plurality of protrusions.

10. The assembly according to claim 7, wherein said plurality of toy figures, said plurality of protrusions and said band are fabricated from elastomeric material.

11. The assembly according to claim 7, wherein said plurality of protrusions are equidistantly spaced along said band.

12. The assembly according to claim 7, wherein said toy figures have a predetermined maximum width and said plurality of protrusions are spaced apart by distances that are at least as wide as said predetermined maximum width.

* * * * *